United States Patent [19]

Hook

[11] Patent Number: 4,816,698

[45] Date of Patent: Mar. 28, 1989

[54] TOUCH CONTROL CIRCUIT FOR INCANDESCENT LAMPS AND THE LIKE

[76] Inventor: Glen C. Hook, 136 W. McKinley, Libertyville, Ill. 60048

[21] Appl. No.: 122,216

[22] Filed: Nov. 18, 1987

[51] Int. Cl.[4] ..... H05B 37/02

[52] U.S. Cl. ..... 307/116; 307/114; 323/245; 323/905; 323/904; 315/362

[58] Field of Search ..... 307/115–117, 307/157, 140, 144, 141, 308, 232, 311; 200/DIG. 1, DIG. 2, 5 R, 33 R; 315/150, 156, 194, 199, 208, 292, 293, 291, 360, 361, 362, 307; 323/300, 319, 905, 238, 323, 904; 361/174, 175, 176, 177, 178, 179, 180, 181, 182, 183, 184

[56] References Cited

U.S. PATENT DOCUMENTS

| | | | |
|---|---|---|---|
| 3,805,096 | 4/1974 | Hamilton, II | 307/308 |
| 4,087,702 | 5/1978 | Kirby et al. | 307/308 X |
| 4,119,864 | 10/1978 | Petrizio | 307/116 |
| 4,213,061 | 7/1980 | Conner | 307/116 |
| 4,246,494 | 1/1981 | Foreman et al. | 307/116 |
| 4,287,468 | 9/1981 | Sherman | 323/319 X |
| 4,482,844 | 11/1984 | Schweer et al. | 315/194 |
| 4,584,519 | 4/1986 | Gruodis | 323/245 |
| 4,591,765 | 5/1986 | Berk | 307/144 X |
| 4,651,022 | 3/1987 | Cowley | 307/114 |
| 4,668,876 | 5/1987 | Skarman | 323/300 X |
| 4,668,877 | 5/1987 | Kunen | 307/116 |
| 4,689,548 | 8/1987 | Mechlenburg | 323/300 |
| 4,701,676 | 10/1987 | Gibson | 315/362 |

*Primary Examiner*—William M. Shoop, Jr.
*Assistant Examiner*—Paul Ip
*Attorney, Agent, or Firm*—Todd S. Parkhurst

[57] ABSTRACT

A touch control circuit is disclosed, which delivers power at any one of a plurality of different levels. To accomplish this, a line cycle delay timer provides a plurality of output signals, each signal being spaced apart in time from the line voltage zero crossing time and from each other. Power level memory and gating means gate the timer output signals to the power delivery means so as to trigger the power delivery means at any one of a number of different levels. A touch detector is connected to the power level memory means. Touch detector circuitry alters the power level memory so as to correspondingly alter the power delivered by the power delivery means when the touch detector is touched.

5 Claims, 3 Drawing Sheets

DEC1
DEC2
DEC3
Q1
Q2
Q3
Q4
Q5
Q6
Q7
INV
INV
VDD
GND
BRITE
BRIOUT
LINOUT
INVIN
INVOUT
PUMPRC
RGND
PUMP UP
CLK
VDD

TOUCH CONTROL CIRCUIT FOR INCANDESCENT LAMPS AND THE LIKE

BACKGROUND OF THE INVENTION

This invention relates generally to electronic circuits known as touch controls for electric lamps, and more particularly concerns a touch control circuit which can be manufactured at modest cost, yet which has a long service life and which does not require trimming or adjustment of components once the circuit has been assembled.

Touch control circuits are becoming increasingly popular for use with electric incandescent lamps such as floor lamps and desk lamps used in homes and offices. These touch control circuits make easy the adjustment of light intensity even by physically disabled or impaired persons. When such circuitry is employed, the lamp user need only touch the lamp base or other metal portion of the lamp to turn the lamp on, or to adjust the light coming from the lamp to a low, medium or high intensity. The lamp user is no longer required to fumble in the dark for a small screw switch located inside a shade.

Previous touch control circuits have been offered to the public in a variety of forms. One popular device takes the form of a self-contained unit of modest dimensions and having a male connector for screw insertion into a standard lamp bulb socket, and a standard female socket which accepts the lightbulb. Functionally interposed between the unit male and female sockets is a circuit board bearing the electronic circuitry. At least some such units are expensive to manufacture, and consequently the product sales have been of relatively low volume. In addition, the products of some designs have experienced triac and other component failures at an unacceptably high rate.

It is accordingly the general object of the present invention to provide a touch-control circuit for electric incandescent lamps which can be manufactured at an attractive cost. A related object of the invention is to provide a touch control lamp circuit which does not require trimming or adjustment of circuit components.

Another object is to provide such a circuit in which circuit sensitivity and operational performance is improved.

Yet another object is to provide a touch control circuit which will have extended circuit component performance and life.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and the scope of the invention as defined by the appended claims.

Figure 1:
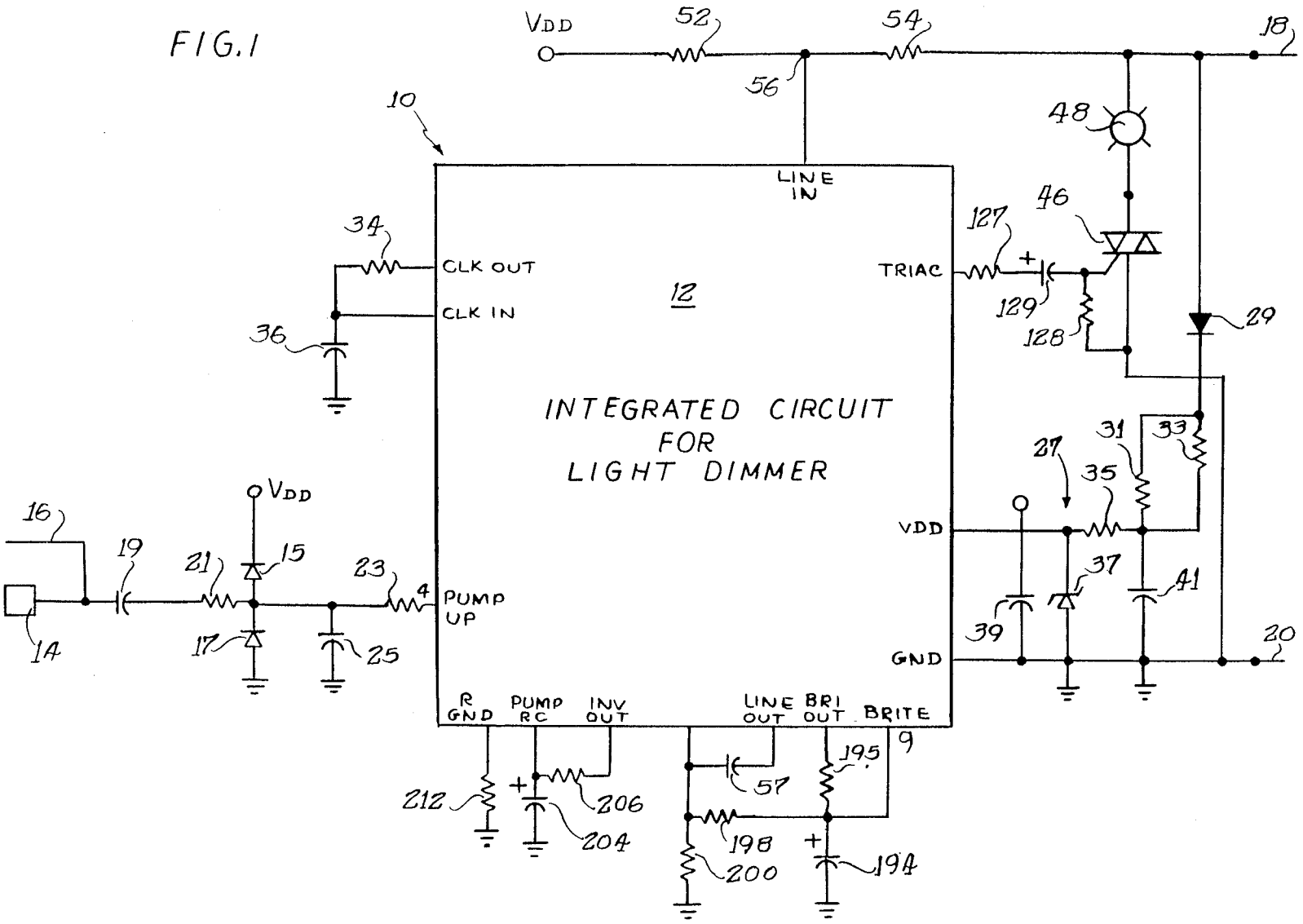
FIG. 1 is a generalized schematic drawing of the circuit embodying the present invention and showing a large scale integrated circuit and discreet components connected thereto.

Turning first to FIG. 1, there is shown a circuit in its general schematic appearance. This circuit 10 includes a Large Scale Integrated Circuit 12, to which a touch sensor 14 is electrically connected. This touch input may take the form of a lamp base or other metal component. A contact device 16, which can consist of a wire or a finger having a distal end to which a set screw is appended, provides an electrical circuit path between the circuit 12 and related components and metallic portions of the lamp such as the lamp socket or base. Diodes 15, 17 are connected to capacitor 19, resistors 21 and 23 and capacitor 25 to protect against transient voltages entering the integrated circuit chip 12 and damaging it.

Figure 2A:
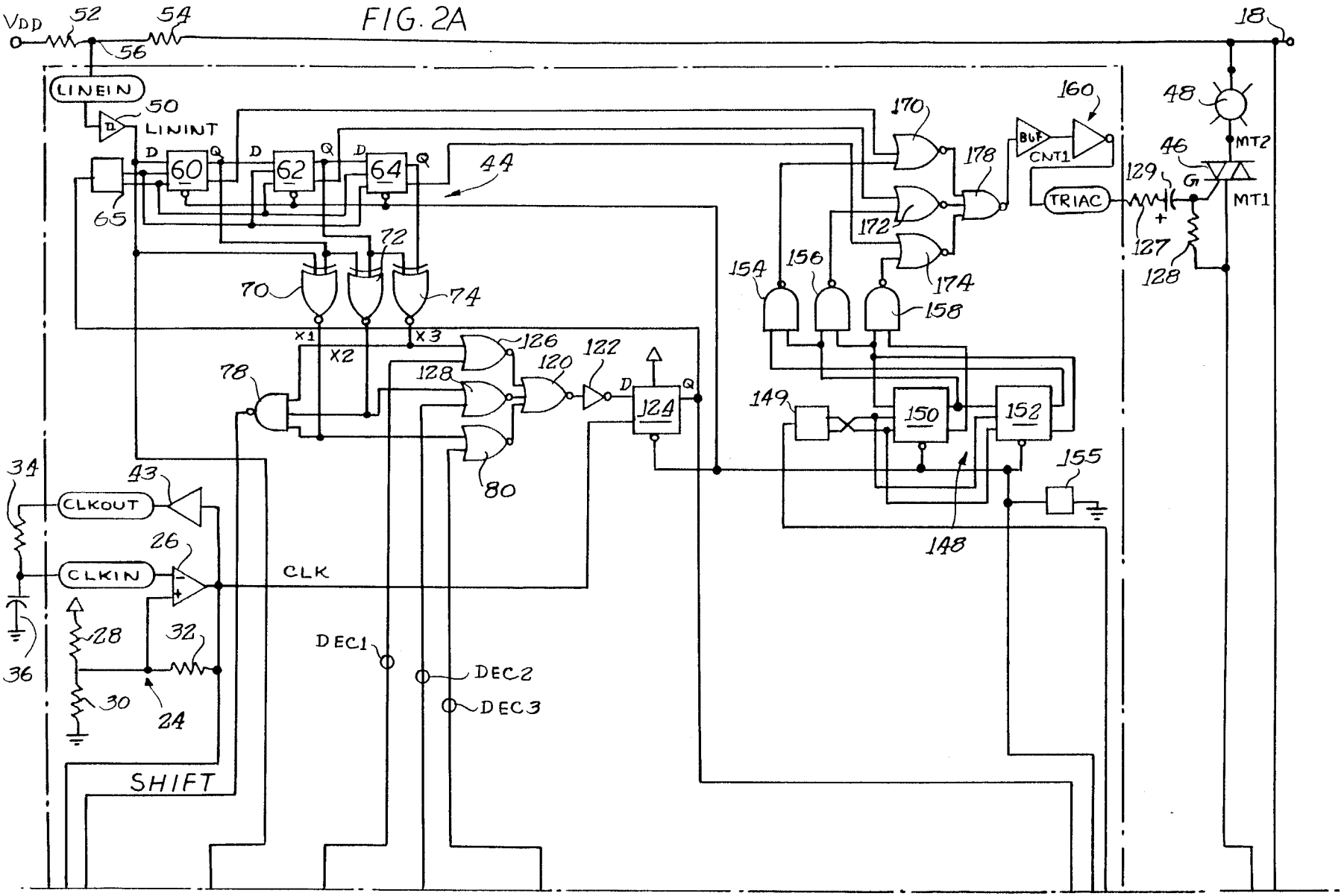
FIGS. 2A and 2B are schematic electrical circuit diagrams showing in further detail the connection arrangements and components of the circuit shown in FIG. 1. It will be understood that the circuit path lines extending to the bottom of FIG. 2A are intended to mate with the circuit path lines extending to the top of FIG. 2B.
Figure 2B:
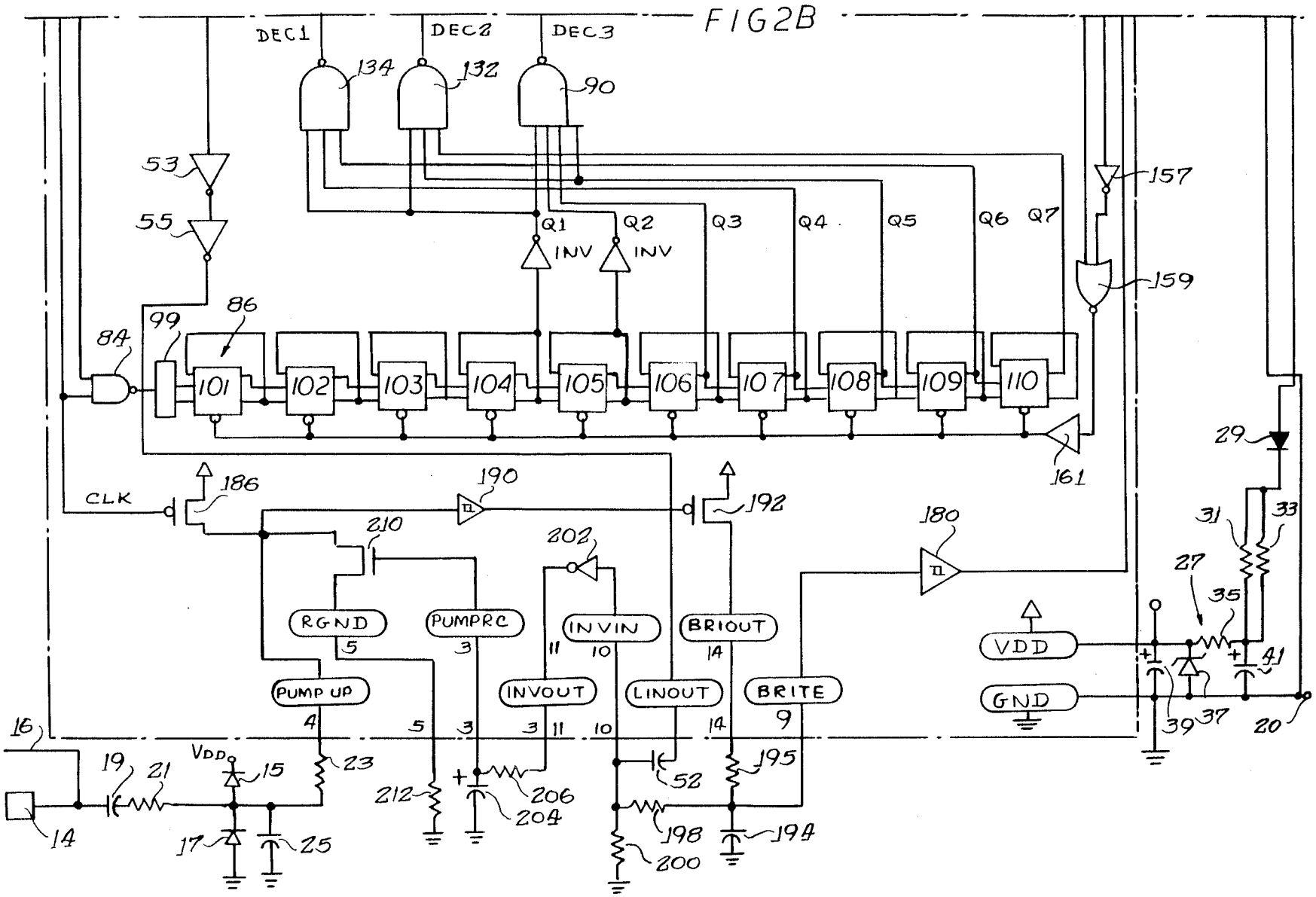

Standard household current is supplied to the circuit 10 through leads 18, 20. To provide the Vdd voltage required at various locations within the integrated circuit 12, a power supply is formed by a diode 29, resistors 31, 33 and 35, a zener diode 37 and capacitors 39 and 41. Other portions of the circuit will be described in detail in reference to FIGS. 2A and 2B.

Master Oscillator

A master oscillator arrangement 24 forms the master timer for the touch lamp control. This oscillator 24 consists of an operational amplifier 26 and three threshold resistors 28, 30, 32 which can be located or diffused internally on the integrated circuit 12. The oscillator 24 also includes an external resistor 34 and a capacitor 36. The internal diffused resistors 28, 30, 32 form a positive feedback network to accurately establish the threshold switch points of the oscillator. Since the resistors are diffused within the IC wafer and are designed to be nominally of the same value (20K ohms), the resistance ratio values track within 2% of each other. An operational amplifier 40 has an input offset voltage of 10 to 20 mV. which is almost negligeable (0.4%) when compared to the vss supply voltage of 5 volts. The combination of the resistor ratio tolerance and the input offset voltage results in a 50% duty cycle oscillator circuit which can deviate a maximum of 2.4% from the nominal. The external resistor 34 is a 30.1K ohm (+ or −1%) resistor which, when used with a 100 pF 5% NPO capacitor 36, will cause the oscillator 24 to operate at 200 KHz + or −7% (worst case).

The output of the oscillator 24 is a digital square wave signal which is buffered by a OPD4 output buffer 43 which is rated for a nominal load of 4 mA. This arrangement provides sufficient output capability to the timing RC load to insure a full Vdd to Vss output voltage swing. The tolerance effects of the circuit values will affect the initial operating brightness levels, but will change relatively little due to operating voltage or temperature changes. In accordance with one aspect of the invention, then, no trimming or adjustment of circuit components is required.

Line Cycle Delay Timer

A line cycle delay timer 44 provides three outputs which are digitally timed and synchronized in phase from the zero crossing of the AC line voltage. Each of the outputs are timed to correspond to the precise trigger point of the output Triac 46 so as to produce the required power level to be applied to the lamp 48 being controlled. The required power levels correspond to a voltage measured with an average-reading Voltmeter as follows:

| (All readings are at 120 vac input line) | | |
|---|---|---|
| Condition | Voltage at Lamp | Req'd Phase Delay |
| (1) Low Level | 25 vac +/− 5 vac | 5.818 mS |
| (2) Med Level | 60 vac +/− 10 vac | 4.166 mS |
| (3) High Level | 115 vac min | <1.091 mS |
| (4) Off | Ovac | output never triggered |

The zero crossing point and the line voltage phase information is detected by a Schmitt input non inverting gate 50 which is a DS1527 gate. (The numbers correspond to the nominal threshold voltages of the gate, i.e. 1527=1.5 v and 2.7 v for the lower and upper thresholds respectively.) The input to this gate 50 is the midpoint of a two resistor voltage divider 52 and 54. These resistors 52 and 54 are high in value (330K ohms) so as to limit the applied line voltage to a peak current of 0.56 mA. Double inverters 53 and 55 deliver a properly buffered LINOUT signal from the integrated circuit 12 (FIG. 2B) through a capacitor 57. The LINEIN voltage at the input node 56 to the gate 50 is limited to Vdd+0.5 v and Vss−0.5 v by the clamping action of the input protection networks provided at each of the input and output pins within the integrated circuit 12.

When the AC line voltage is positive with respect to ground GND (FIG. 2B) the output of the gate 50 is high or logic one (1). When the AC line is negative with respect to ground GND, the output of the gate 50 is low or logic zero (0). This logic signal is referenced as LININT in FIG. 2A. LININT is applied to the D input of the first of three D Flip-Flops 60, 62, 64, each with a Reset. These are referred to as DFFR Flip-Flops. These three Flip-Flops 60, 62, 64 are connected in series with each other so as to form a ripple counter with a common clock and reset for all three stages. A clock signal generator 65 is provided for the Flip-Flops 60–64. Exclusive NOR gates 70, 72, 74 are connected from each D input and each Q output of the respective Flip-Flops 60, 62, 64 so as to detect when the input is different from the output. Specifically, whenever the line voltage crosses zero the input and output will be different for Flip-Flop 60 and EXNOR gate 70 will have a logical zero at its output. This signal (X1) when at a logic zero results in a logic one at the output of NAN3 gate 78 and also enables one of the NOR2 gate 80 inputs. The gate 78 output signal (SHIFT) is connected to one input of NAN2 gate 84 (FIG. 2B) which is used to turn on and off the (CLK) to a 10-bit binary counter circuit 86. The output of gate 80 remains at logic zero until the signal (DEC3) output of NAN4 gate 90 also goes to logic zero. This will occur when all four inputs to gate 90 are logical 1.

The ten DFFR Flip-Flops 101–110 are connected to form a 10 bit binary counter 86 with reset, and are used to count the oscillations produced by the 200 KHz oscillator 24 to produce very precise time delays. A clock signal generator 99 synchronizes actions of the Flip-Flops 101–110. The four inputs to gate 90 are connected to the Q1, Q2, Q3, and Q5 outputs from the 10 bit binary counter, and will all be at logic 1 approximately 0.92 mS after the line zero crossing occurs. The output from gate 90 is a signal (DEC3) which will cause gate 80 output to go to logic one when both (DEC3) and (X1) are logic zero. NOR3 gate 120 with inverter 122 form an OR gate function which will present a logic one to the D input of Flip-Flop 124 whenever any of the gates 126, 128, or 80 have a logical one at their outputs. This will occur 0.92 mS after the line crosses zero when gate 80 output is logical 1. The clock input to 124 is in the last half of the same 200 KHz CLK cycle which initiated the zero output from gate 90 (DEC3).

When Flip-Flop 124 Q output goes to logic 1, two actions take place. The 10 stage Binary counter is reset to zero at all outputs, and Flip-Flops 60, 62 and 64 are clocked so that the D input signal is clocked to the Q output of each Flip-Flop. The first clock pulse after the zero crossing will only affect Flip-Flop 60 because that is the only Flip-Flop which has different signals on its D and Q pins prior to the clock pulse. Flip-Flop 60 will now have the D and Q signals the same after the clock pulse and Flip-Flop 62 will have different D and Q signals. This difference of D and Q signals in Flip-Flop 62 will cause a zero at the output of EXNOR gate 72 (signal X2). This then causes gate 78 output to go to logic one again, and the result is that the clocking of the 10 bit binary counter 86 is again enabled by gate 84. In addition, NOR2 gate 128 has one input at logic zero and is waiting for the other input to go to logic zero in order to reapply a logic one at the D input of Flip-Flop 124 once again. This will happen when the 10 bit binary counter 86 causes logic ones to appear at all the inputs of NAN3 gate 132 (signal DEC2). This will occur when 3.24 mS have elapsed since DEC3 went to logic zero for a total elapsed time since zero crossing of 4.16 mS. The output of Flip-Flop 124 once again goes to logic one causing reset of the 10 bit binary counter 86 and clocking of the Flip-Flops 60, 62, and 64. This time Flip-Flop 62 changes its Q output to match its D input. Now Flip-Flop 64 has different D and Q signals causing EXNOR gate 74 to go to logic zero at its output (signal X3). This again restarts the clocking of the 10 bit binary counter 86 and enables NOR2 gate 126 whenever the counter has all inputs of NAN3 gate 134 in a logic one condition. This will occur 1.64 mS after Flip-Flop 124 was last set for a cumulative time total of 5.80 mS after the zero crossing occured.

The 10 bit binary counter 86 and the Flip-Flops 60, 62 and 64 will remain in this condition until the next zero crossing of the ac line voltage again starts the entire sequence of events. This time, however, the polarity cf the three timed signals is reversed from the previous half line cycle. Note also that the polarity of the timed signals matches the polarity of the ac line so that the proper quadrant I (MT2+,G+) and III (MT2−,G−) gating signals can be supplied to the Triac 46 by the power level memory and gating circuitry. An r-c time constant circuit including resistors 127 and 128 and capacitor 129 reshape, by differentiation, the square wave trigger signal TRIAC for delivery to the gate of the triac 46.

Power Level Memory and Gating

Power level memory and gating circuitry provide a means of gating the three delayed signals to produce the proper triggering of the Triac 46 in response to touch signals which are latched in a modulo four Flip-Flop counter 148 which includes Flip-Flops 150 and 152. A clock signal generator 149 synchronizes the actions of the Flip-Flops 150 and 152. Power on reset circuitry 155 provides a logic 0 to the Flip-Flops 150 and 152 when the circuitry is first powered up. This circuitry 155 also provides an initialization logic 1 to the binary counter 86 components via an inverter 157, AND gate 159, and buffer 161. The four possible states of the modulo four counter 148 are decoded by three NAN2 gates 154, 156, and 158. The gates normally have their output in the logic one state except when both inputs of a particular gate are at a logic one state. When this occurs the gate output goes to zero, and one of three NOR2 gates 154–158 are enabled, thus passing the proper phase delayed signal thru to the high current output driver OPDT 160 which actually triggers the Triac 46. The three NOR2 gates 170, 172 and 174 correspond to high, medium, and low power (light) levels respectively. If none of the gates 170–174 are enabled, the Triac 46 will never be triggered, thereby allowing the lamp 48 to remain in its off condition.

To clock or advance the logic state of the modulo four counter Flip-Flops 150, 152 requires that the signal at pin 9 (BRITE) of the integrated circuit 12 (FIG. 1) be level-detected by a Schmitt gate 180 (FIG. 2B) and connected to the clock input of the counter 148. This (BRITE) signal input is the detected touch output signal produced by the touch detector circuitry.

Touch Detector

For the purposes of illustrating the operation of the circuit, assume that all capacitors are initially discharged and the power to the chip 12 has reached the nominal five volt level. The oscillator 24 will initially come up in the logic one state until approximately five microseconds (μS) has elapsed, after which the continuous and usual high low output oscillation will be established. The output of the oscillator 24 (CLK) is connected to the gate of a P-channel CMOS transistor 186 (FIG. 2B) which is used to charge the total circuit capacitance at pin 4 (PUMPUP) to five volts whenever the (CLK) is in the logic zero state. When the voltage at pin 4 (PUMPUP) is above the upper threshold of Schmitt gate 190, the output of this gate 190 will also be at logic one (high) resulting in the P-channel CMOS transistor 192 connected to the output of this gate 190 to be switched off. The drain of this CMOS transistor 192 stops sourcing current to pin 14 (BRIOUT) and the capacitor 194 begins to discharge thru resistors 198 and 200. (Actually the voltage on capacitor 194 after the initial 5 μS clock cycle is a very small amount which, when further decreased by the voltage dividing action of resistors 198 and 200 applied to pin 10 (INVIN), results in a logic low input to an inverter 202). The output of this inverter 202 goes to a logic one which applies five volts to pin 11 (INVOUT) which in turn begins to charge capacitor 204 thru a 3.3 MEG Ohm resistor 206 which forms an RC integrator network with a time constant of 3.3 seconds. The junction 208 of resistor 206 and capacitor 204 are connected to pin 3 (PUMPRC) which internally connects to the gate of an N-channel CMOS transistor 210. The drain of this transistor connects to pin 4 (PUMPUP) and the source connects to pin 5 (RGND), which is connected to signal ground thru a 2.2K Ohm resistor 212.

The various components, when connected as described, form a highly compliant current sink whose output current level is determined by the voltage applied to pin 3 (PUMPRC). When the pin 3 voltage is less than the threshold voltage of the N-channel transistor 210, there can be no current sink action at pin 4 (PUMPUP) resulting in the circuit total capacitance not being discharged and the Schmitt gate 190 remaining in the logical high condition. This results in the P-channel transistor 192 connection at pin 14 remaining non-conducting so that the voltage at pin 10 (INVIN) remains low with the pin 11(INVOUT) remaining high, thereby continuing the charging action on the capacitor 204. As soon as the voltage of the capacitor 204 increases to a value higher than the threshold voltage of the transistor 210, the transistor 210 will begin to conduct causing a discharge action to take place at pin 4 (PUMPUP) every half cycle of (CLK) when it is logically high and turns off the P-channel transistor 186. The sink current will gradually increase until the discharge action results in the lower threshold of the Schmitt gate 190 being exceeded, resulting in the P-channel transistor 192 at pin 14 (BRIOUT) being turned on for a short time thereby pumping some charge into capacitor 194 through resistor 195 and increasing capacitor 194 voltage by a small amount. This action continues until the voltage at pin 10 (INVIN) increases to the threshold point of the inverter 202. When this happens the total circuit will stabilize in a state of equilibrium, resulting in the voltage on capacitor 194 exceeding the upper threshold voltage of gate 180, the gate which advances the state of the modulo-four counter 148 and thereby controlling the output power. The unit will remain in a state of equilibrium, continually adjusting for gradual changes in input circuit capacitance. If a sudden increase in capacitance occurs, such as from a touch on the input 14, the discharge current level at pin 4 (PUMPUP) will be insufficient to lower the node voltage within the half cycle time of the CLK and Schmitt trigger 190 will remain in the logic high condition, causing the pulsing at pin 14 (BRIOUT) to cease allowing capacitor 194 to discharge to the lower threshold of Schmitt trigger 180 thereby producing a clock pulse which advances the logical state of the modulo four counter 148 and changing the light level.

Because the BRITE clocking signal is bypassed by capacitor 194; because the PUMPRC signal is bypassed by capacitor 204; and because the touch signal PUMPUP is bypassed by capacitor 25, differential mode signals are not introduced into the circuit. In accordance with the invention, then, these circuit noise and spurious signals do not affect the circuit or performance of the lamp touch control device.

I claim:

1. A power delivery means capable of delivering power at any one of a plurality of different levels, comprising an electrical path for an alternating current which varies from a positive to a negative voltage across a regularly occuring zero crossing time, a line cycle delay timer means for providing a plurality of output signals, each of which are spaced apart in time from the line voltage zero crossing time, power level memory and gating means for gating the timer output signals to the power delivery means to trigger the power delivery means at any one of said different levels, and touch detector means connected to the power level memory means for sensing a touch from an outside source and altering the power level memory so as to correspondingly alter the power delivered by the power delivery means.

2. A device according to claim 1 further including an incandescent light bulb socket connected to said power delivery means, whereby the intensity of illumination emanating from a light bulb installed in the socket can be varied between any one of a plurality of levels corresponding to the level of power delivered to the socket and light bulb.

3. A device according to claim 2 further including male connector means for electrically connecting and mechanically mounting the device to a female lamp socket.

4. A device according to claim 1 wherein said power level memory and gating means includes a modulo four Flip-Flop counter.

5. A device according to claim 4 wherein said touch detector means includes a capacitor, a touch sensor connected to the capacitor, and a gate means connected to the capacitor, whereby a gate pulse is delivered to said power level memory counter when the touch sensor is touched and the capacitance in the capacitor is thereby changed, so that a touch applied to the touch sensor changes the power delivered by the device.

* * * * *